US006968985B1

(12) United States Patent
Caccavallo

(10) Patent No.: US 6,968,985 B1
(45) Date of Patent: Nov. 29, 2005

(54) HAT SHAPING AND DRYING SUPPORT ASSEMBLY

(76) Inventor: Salvatore S. Caccavallo, 25 McCabe Dr., Streamwood, IL (US) 60107

( * ) Notice: Subject to any disclaimer, the term of this patent is extended or adjusted under 35 U.S.C. 154(b) by 60 days.

(21) Appl. No.: 10/653,180

(22) Filed: Sep. 3, 2003

(51) Int. Cl.[7] ..... A42C 1/00
(52) U.S. Cl. ..... 223/24; 223/25
(58) Field of Search ..... 223/24, 25, 12, 223/15

(56) References Cited

U.S. PATENT DOCUMENTS 1,914,864 A * 6/1933 Purcell ..... 223/25
4,708,271 A 11/1987 Grommes
4,739,908 A 4/1988 Bury
5,172,837 A 12/1992 Finney, Jr. et al.
5,725,134 A 3/1998 Weltge

* cited by examiner

*Primary Examiner*—John J. Calvert
*Assistant Examiner*—James G Smith

(57) ABSTRACT

A hat shaping and drying support assembly includes a base with a back portion and a front portion. Each of the front and back portions has a bottom side, a top side, a pair of lateral sides, an outer side and an inner side wherein the inner sides face toward each other. A rear frame is attached to and extends upwardly from the top side of the back portion and a front frame is attached to and extends upwardly from the top side of the front portion. A coupler is mounted to the rear and front frames such that the rear and front frames may be selectively moved with respect to each other. A biasing assembly is attached to the coupler for selectively biasing the back and front portions away from each other. A wet hat is positioned on the front and rear frames for drying and shaping.

19 Claims, 4 Drawing Sheets

HAT SHAPING AND DRYING SUPPORT ASSEMBLY

BACKGROUND OF THE INVENTION

1. Field of the Invention

The present invention relates to baseball cap size retaining devices and more particularly pertains to a new baseball cap size retaining device for supporting and shaping a hat while it dries.

2. Description of the Prior Art

The use of baseball cap size retaining devices is known in the prior art. U.S. Pat. No. 5,172,837 describes a cage-like device for holding a hat so that it may be positioned in a dishwasher and cleaned while retaining its shape. Another type of cap size retaining device is U.S. Pat. No. 4,708,271 adapted for holding a hat for drying purposes.

While these devices fulfill their respective, particular objectives and requirements, the need remains for a device that is adaptable for a variety of sized baseball caps and includes a frame that allows sufficient airflow for quick drying of a wet hat.

SUMMARY OF THE INVENTION

The present invention meets the needs presented above by including a front frame and back frame that are biased apart from each other for stretching a hat while it dries to retain its shape and stiffness.

Another object of the present invention is to provide a new baseball cap size retaining device that utilizes front and back frames that are open lattices for providing better airflow around the hat.

To this end, the present invention generally comprises a base including a back portion and a front portion. Each of the front and back portions has a bottom side, a top side, a pair of lateral sides, an outer side and an inner side wherein the inner sides face toward each other and the outer sides face away from each other. The back and front portions are spaced from each other. A rear frame is attached to and extends upwardly from the top side of the back portion and a front frame is attached to and extends upwardly from the top side of the front portion. A coupler is mounted to the rear and front frames such that the rear and front frames may be selectively moved between a position abutting each other and a position spaced from each other. A biasing assembly is attached to the coupler for selectively biasing the back and front portions away from each other. A wet hat is positioned on the front and rear frames for drying and shaping.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
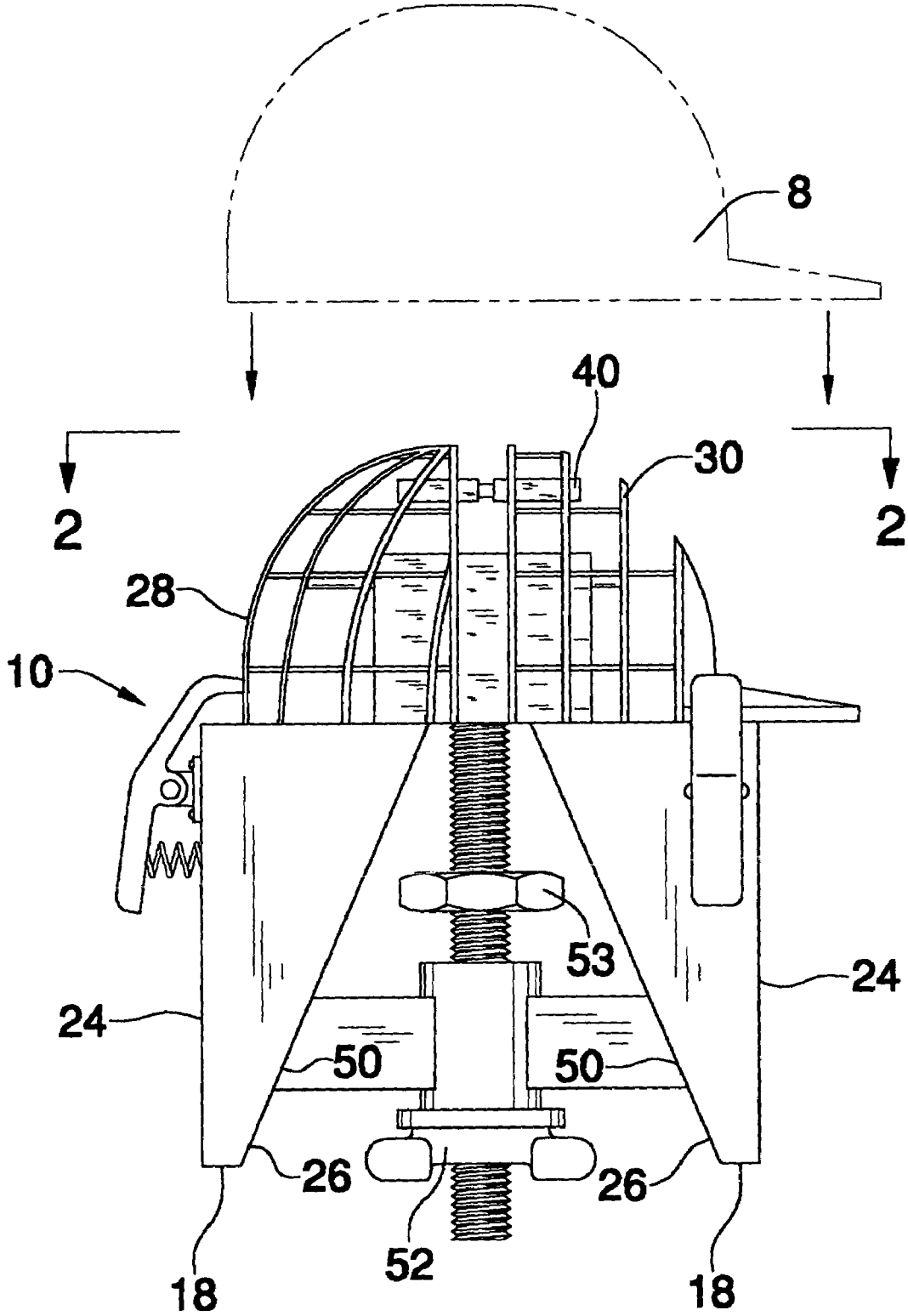
FIG. 1 is a schematic side view of a hat shaping and drying support assembly according to the present invention.
Figure 2:
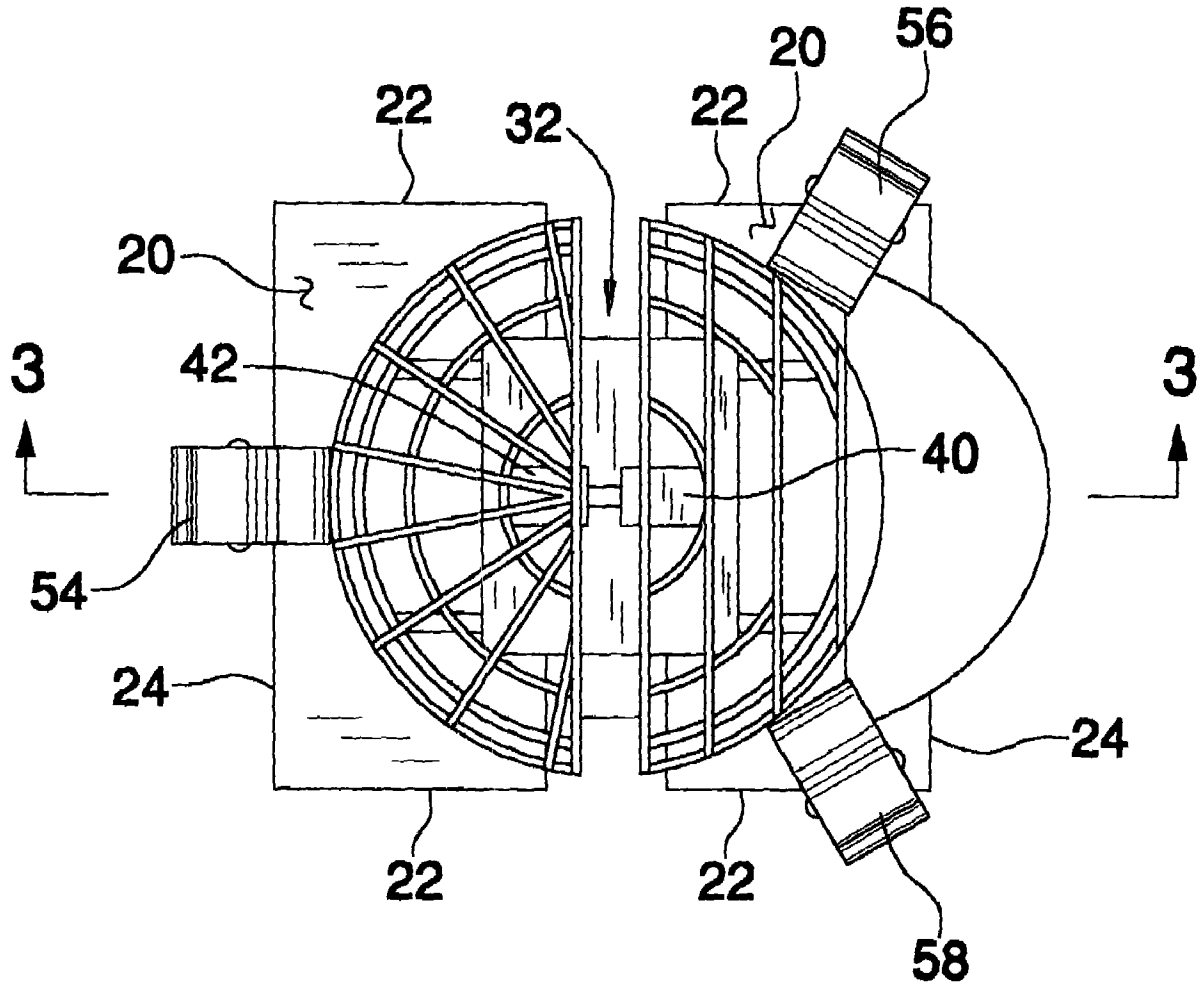
FIG. 2 is a schematic top view of the present invention.
Figure 3:
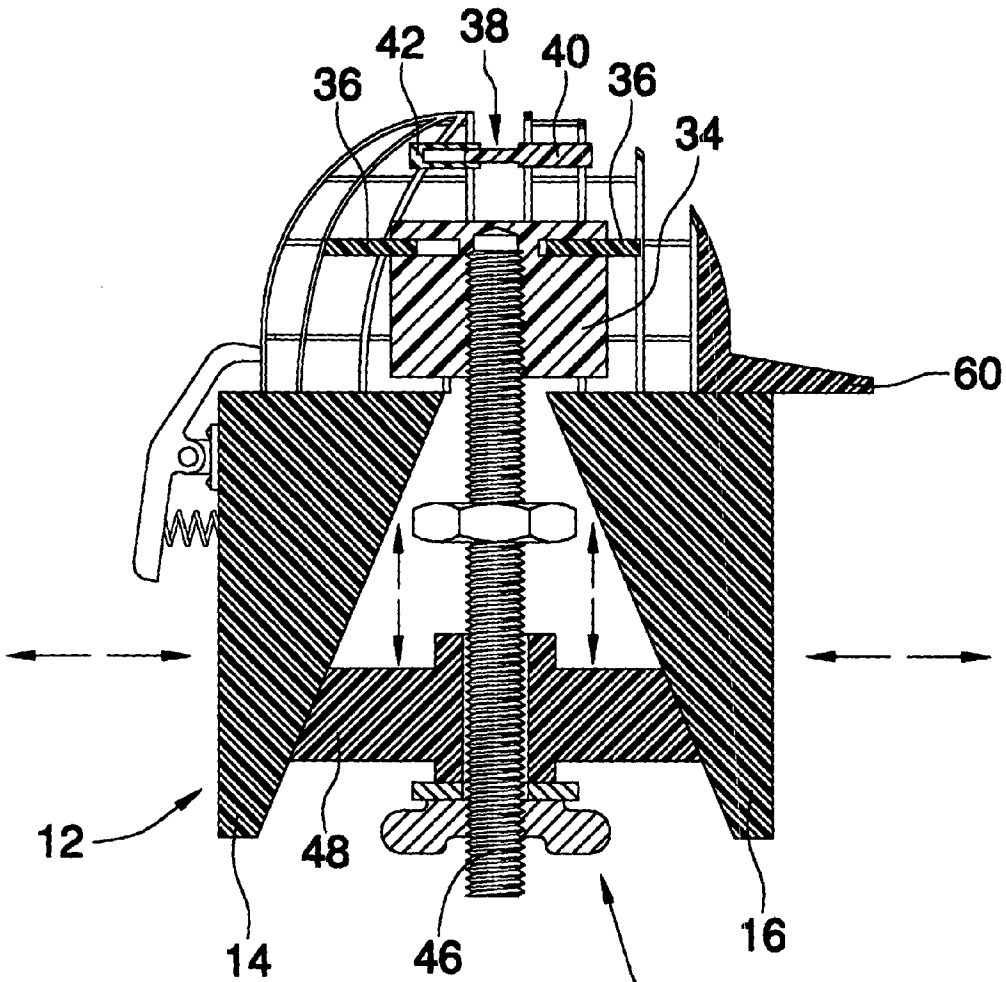
FIG. 3 is a schematic cross-sectional view taken along line 3—3 of FIG. 2 of the present invention.
Figure 4:
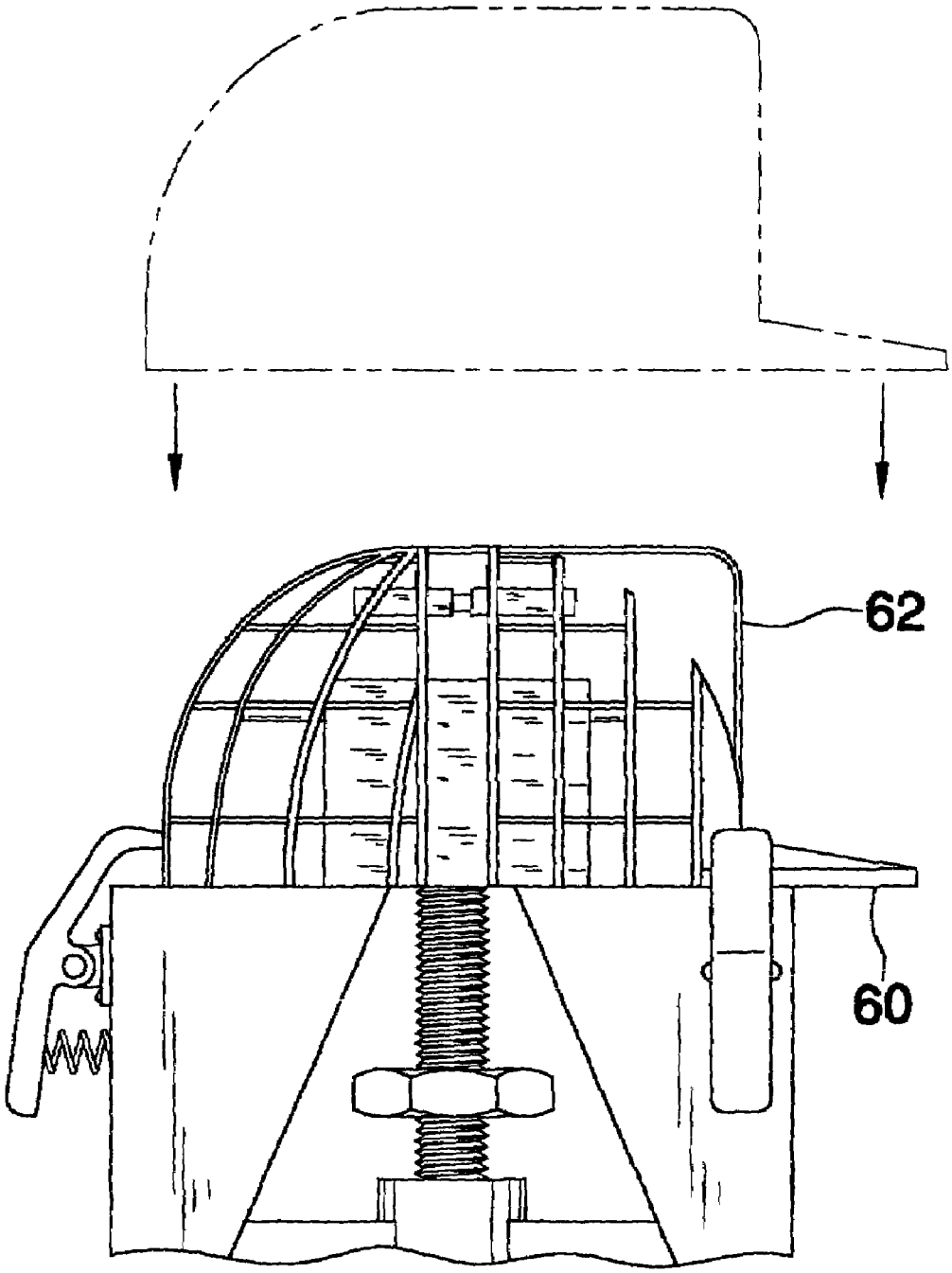
FIG. 4 is a schematic side view of the present invention.

With reference now to the drawings, and in particular to FIGS. 1 through 4 thereof, a new baseball cap size retaining device embodying the principles and concepts of the present invention and generally designated by the reference numeral 10 will be described.

As best illustrated in FIGS. 1 through 4, the hat shaping and drying support assembly 10 generally comprises a base 12 including a back portion 14 and a front portion 16. Each of the front 14 and back 16 portions has a bottom side 18, a top side 20, a pair of lateral sides 22, an outer side 24 and an inner side 26 wherein the inner sides 26 face toward each other and the outer sides 24 face away from each other. The back 14 and front 16 portions are spaced from each other. The inner sides 26 are each angled such that the top sides 20 and an abutting one of the inner sides 26 forms an acute angle.

A rear frame 28 is attached to and extends upwardly from the top side 20 of the back portion 14 and a front frame 30 is attached to and extends upwardly from the top side 20 of the front portion 16. Each of the rear 28 and front 30 frames generally has a half-dome shape such that a dome is formed by the rear 28 and front 30 frames when the back 14 and front 16 portions adjacent to each other. Each of the front 30 and rear 28 frames comprises an open lattice such that air may freely flow through the frames. Preferably, the frames 28, 30 extend over an edge formed by the top side 22 and an associated one of the inner sides 26.

A coupler 32 is mounted to the rear 28 and front 30 frames such that the rear 28 and front 30 frames may be selectively moved between a position abutting each other and a position spaced from each other. The coupler 32 includes a saddle 34 positioned above the top sides 20. Each of a pair of plates 36 is attached to one of the rear 28 and front 30 frames and each slidably extends into opposite surfaces of the saddle 34 such that each of the plates 36 is within an associated one of the front 28 and rear 30 frames.

Preferably, a stabilizer 38 is attached to the rear 28 and front 30 frames for stabilizing movement of the rear 28 and front 30 frames with respect to each other. The stabilizer 38 includes a male coupler 40 attached to and mounted in the front frame 30 and a female coupler 42 attached to and mounted in the rear frame 28. The male coupler 40 is selectively extendable into the female coupler 42. The stabilizer 38 is ideally positioned generally adjacent to an apex of the rear 28 and front 30 frames.

A biasing assembly 44 is attached to the coupler 32 for selectively biasing the back 14 and front 16 portions away from each other. The biasing assembly 44 includes rod 46 that is attached to the saddle 34 and extends downwardly therefrom such that the rod 46 is positioned between the inner sides 26. The rod 46 is threaded for receiving threaded nuts. A panel 48 has a pair of end edges 50 that are each angled inward from a bottom to a top of the panel 48. The rod 46 extends through the panel 48 such that each of the end edges 50 abuts one of the inner sides 26. A threaded nut 52 is threadably coupled to the rod 46 such that the panel 48 is positioned between the nut 52 and the saddle 34. The panel 48 may be biased upwardly by rotation of the nut 52 in a first direction such that the panel 48 biases the front 16 and back 14 portions away from each other. A second nut 53 may be positioned between the panel 48 and the saddle 34 for selectively locking the position of the panel 48 relative to the saddle 34.

A plurality of clip members is attached to the base 12 for releasably securing a baseball cap 8 on the front 30 and back 28 frames. A first clip 54 of the clip members is mounted on the outer side 24 of the back portion 14 and is biased against the rear frame 28. Each of a second clip 56 and a third clip 58 is attached to one of the lateral sides 22 of the front portion 18 and is biased against the front frame 30. The clips are preferably biased with springs.

Additional elements may be added for enhancing the shaping of a baseball cap 8. These include a brim 60 being attached to and extending forward from the front frame 30. The brim 60 is positioned adjacent to the top side 20 of the front portion 18. Also, additional frame members 62 may be attached to the front frame 30 for fitting different shaped hats on the assembly.

In use, a wet hat, such as a baseball cap 8, is positioned on the rear 28 and front 30 frames and secured in place with the clips 54, 56, 58. The biasing assembly 44 is used to force the rear 28 and front 30 frames apart from each other to stretch the hat. This action preserves the stiffness and shape of the hat while air moving around the frames 28, 30 aids in drying the hat. Alternatively, the hat may be washed while on the assembly 10 and retained thereon to dry.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hat shaping and drying rack combination device for selectively supporting a baseball cap, said device comprising:

a base including a back portion and a front portion, each of said front and back portions having a bottom side, a top side, a pair of lateral sides, an outer side and an inner side wherein said inner sides face toward each other and said outer sides face away from each other, said back and front portions being spaced from each other, said inner sides each being angled such that said top sides and an abutting one of said inner sides forms an acute angle;

a rear frame and a front frame, said rear frame being attached to and extending upwardly from said top side of said back portion, said front frame being attached to and extending upwardly from said top side of said front portion;

a coupler being mounted to said rear and front frames such that said rear and front frames may be selectively moved between a position abutting each other and a position spaced from each other;

a biasing assembly being attached to said coupler for selectively biasing said back and front portions away from each other; and wherein a wet hat is positioned on the front and rear frames for drying and shaping.

2. The device of claim 1, wherein each of said rear and front frames generally have a half-dome shape such that a dome is formed by said rear and front frames when said back and front portions adjacent to each other.

3. The device of claim 1, wherein said coupler includes a saddle, each of a pair of plates being attached to one of said rear and front frames and slidably extending into opposite surfaces of said saddle such that each of said plates is within an associated one of said front and rear frames.

4. The device of claim 1, wherein said coupler includes a saddle, each of a pair of plates being attached to one of said rear and front frames and slidably extending into opposite surfaces of said saddle such that each of said plates is within an associated one of said front and rear frames.

5. The device of claim 1, wherein each of said front and rear frames comprises an open lattice.

6. The device of claim 1, further including a stabilizer being attached to said rear and front frames for stabilizing movement of said rear and front frames with respect to each other.

7. The device of claim 6, wherein said stabilizer includes a male coupler attached to and mounted in said front frame and a female coupler attached to and mounted in said rear frame, said male coupler being selectively extendable into said female coupler.

8. The device of claim 7, wherein said stabilizer is positioned generally adjacent to an apex of said rear and front frames.

9. The device of claim 4, wherein said biasing assembly includes rod being attached to said saddle and extending downwardly therefrom such that said rod is positioned between said inner sides, said rod being threaded, a panel having a pair of end edges, said rod extending through said panel such that each of said end edges are abutting one of said inner sides, a threaded nut being threadably coupled to said rod such that said panel is positioned between said nut and said saddle, wherein said panel may be biased upwardly by rotation of said nut in a first direction such that said panel biases said front and back portions away from each other.

10. The device of claim 9, wherein each of said end edges are angled inward from a bottom to a top of said panel.

11. The device of claim 1, further including a plurality of clip members being attached to said base for releasably securing a baseball cap on said front and back frames.

12. The device of claim 11, wherein a first clip of said clip members is mounted on said outer side of said back portion and being biased against said rear frame, each of a second clip and a third clip being attached to one of said lateral sides of said front portion and being biased against said front frame.

13. The device of claim 4, further including a plurality of clip members being attached to said base for releasably securing a baseball cap on said front and back frames.

14. The device of claim 13, wherein a first clip of said clip members is mounted on said outer side of said back portion and being biased against said rear frame, each of a second clip and a third clip being attached to one of said lateral sides of said front portion and being biased against said front frame.

15. A hat shaping and drying rack combination device for selectively supporting a baseball cap, said device comprising:

a base including a back portion and a front portion, each of said front and back portions having a bottom side, a top side, a pair of lateral sides, an outer side and an inner side wherein said inner sides face toward each other and said outer sides face away from each other, said back and front portions being spaced from each other, said inner sides each being angled such that said top sides and an abutting one of said inner sides forms an acute angle;

a rear frame and a front frame, said rear frame being attached to and extending upwardly from said top side of said back portion, said front frame being attached to and extending upwardly from said top side of said front portion, each of said rear and front frames generally having a half-dome shape such that a dome is formed by said rear and front frames when said back and front portions adjacent to each other, each of said front and rear frames comprising an open lattice;

a coupler being mounted to said rear and front frames such that said rear and front frames may be selectively moved between a position abutting each other and a position spaced from each other, said coupler including a saddle, each of a pair of plates being attached to one of said rear and front frames and slidably extending into opposite surfaces of said saddle such that each of said plates is within an associated one of said front and rear frames;

a stabilizer being attached to said rear and front frames for stabilizing movement of said rear and front frames with respect to each other, said stabilizer including a male coupler attached to and mounted in said front frame and a female coupler attached to and mounted in said rear frame, said male coupler being selectively extendable into said female coupler, said stabilizer being positioned generally adjacent to an apex of said rear and front frames;

a biasing assembly being attached to said coupler for selectively biasing said back and front portions away from each other, said biasing assembly including rod being attached to said saddle and extending downwardly therefrom such that said rod is positioned between said inner sides, said rod being threaded, a panel having a pair of end edges, each of said end edges being angled inward from a bottom to a top of said panel, said rod extending through said panel such that each of said end edges are abutting one of said inner sides, a threaded nut being threadably coupled to said rod such that said panel is positioned between said nut and said saddle, wherein said panel may be biased upwardly by rotation of said nut in a first direction such that said panel biases said front and back portions away from each other; and a plurality of clip members being attached to said base for releasably securing a baseball cap on said front and back frames, a first clip of said clip members being mounted on said outer side of said back portion and being biased against said rear frame, each of a second clip and a third clip being attached to one of said lateral sides of said front portion and being biased against said front frame.

16. A hat shaping and drying rack combination device for selectively supporting a baseball cap, said device comprising:

a base including a back portion and a front portion, each of said front and back portions having a bottom side, a top side, a pair of lateral sides, an outer side and an inner side wherein said inner sides face toward each other and said outer sides face away from each other, said back and front portions being spaced from each other;

a rear frame and a front frame, said rear frame being attached to and extending upwardly from said top side of said back portion, said front frame being attached to and extending upwardly from said top side of said front portion, each of said front and rear frames comprising an open lattice;

a coupler being mounted to said rear and front frames such that said rear and front frames may be selectively moved between a position abutting each other and a position spaced from each other;

a biasing assembly being attached to said coupler for selectively biasing said back and front portions away from each other; and wherein a wet hat is positioned on the front and rear frames for drying and shaping.

17. The device of claim 16, further including a plurality of clip members being attached to said base for releasably securing a baseball cap on said front and back frames.

18. The device of claim 16, further including a stabilizer being attached to said rear and front frames for stabilizing movement of said rear and front frames with respect to each other.

19. The device of claim 18, wherein said stabilizer includes a male coupler attached to and mounted in said front frame and a female coupler attached to and mounted in said rear frame, said male coupler being selectively extendable into said female coupler.

* * * * *